United States Patent [19]

Nishino et al.

[11] Patent Number: 4,714,337

[45] Date of Patent: Dec. 22, 1987

[54] SAFETY MEANS FOR PROCESS KIT

[75] Inventors: Fumio Nishino, Tokyo; Shigeyoshi Onoda, Yokohama; Akihiro Nomura, Kawasaki; Morikazu Mizutani, Tokyo; Shinji Kanemitsu, Ichikawa; Mototada Toriumi, Yokohama, all of Japan

[73] Assignee: Canon Kabushiki Kaisha, Tokyo, Japan

[21] Appl. No.: 937,476

[22] Filed: Dec. 2, 1986

Related U.S. Application Data

[60] Continuation of Ser. No. 849,185, Apr. 7, 1986, abandoned, which is a division of Ser. No. 450,210, Dec. 16, 1982, Pat. No. 4,591,258.

[30] Foreign Application Priority Data

| | | | |
|---|---|---|---|
| Dec. 22, 1981 | [JP] | Japan | 56-208489 |
| Mar. 5, 1982 | [JP] | Japan | 57-35626 |
| May 14, 1982 | [JP] | Japan | 57-81763 |
| May 17, 1982 | [JP] | Japan | 57-82649 |

[51] Int. Cl.[4] ..... G03G 15/00

[52] U.S. Cl. ..... 355/3 DR; 355/3 R; 355/3 CH

[58] Field of Search ..... 355/3 DR, 3 R, 3 CH, 355/14 R, 3 BE, 3 DD, 8, 16

[56] References Cited

U.S. PATENT DOCUMENTS

| | | | |
|---|---|---|---|
| 3,480,361 | 11/1969 | Doi et al. | 355/16 |
| 4,319,828 | 3/1982 | Komori et al. | 355/3 DR X |
| 4,344,700 | 8/1982 | Kasama et al. | 355/3 DR X |
| 4,386,839 | 6/1983 | Kumagai et al. | 355/3 DR |
| 4,386,841 | 6/1983 | Wakao et al. | 355/3 DR |

*Primary Examiner*—A. C. Prescott

*Attorney, Agent, or Firm*—Fitzpatrick, Cella, Harper & Scinto

[57] ABSTRACT

Various components of image-forming means such as corona discharger, developing device and cleaning means are arranged around a photosensitive drum. These processing parts and the photosensitive drum are assembled together into a unit which can be detachably mounted into the main body of image-forming apparatus. Such a unit is called process kit. The process kit is provided with a driving connection member for receiving a driving force from the main body. The present invention provides safety means for effectively protecting said driving connection member from shock and impact thereby assuring the utility of the process kit for a long time.

8 Claims, 11 Drawing Figures

SAFETY MEANS FOR PROCESS KIT

This application is a continuation of application Ser. No. 849,185 filed Apr. 7, 1986, now abandoned, which in turn is a division of application Ser. No. 450,210, filed Dec. 16, 1982, now U.S. Pat. No. 4,591,258.

BACKGROUND OF THE INVENTION

1. Field of the Invention

The present invention relates to a process kit containing a photosensitive drum and processing means arranged around the photosensitive drum as a unit. The process kit can be detachably mounted in the main body of image-forming apparatus.

2. Description of the Prior Art

In a long use of image-forming apparatus, for example, a copying machine employing the well-known electrophotographic process, various maintenance works are required which include exchange of the photosensitive medium, supply or exchange of developer, cleaning of charging wires, and adjustment and repair of functional parts etc. Until now these maintenance works have usually been done by a special service man. However, in order to keep the copying machine always in a good state for operation, there have been proposed some methods which enables the maintenance work to be done without the aid of a special service man. One of the methods is to prepare a process kit by assembling some essential components of the copying apparatus such as corona discharger, developing device and photosensitive drum together into a unit. According to the method, the maintenance can be done by the user himself in a simple manner by replacing the used kit by new one. As a further development of this idea it has been proposed also to prepare different types of process kits which are exchangeably used in one and the same main apparatus according to the purpose for which the user intends to use the apparatus. Obviously this broadens the function of the apparatus because one and the same apparatus can be used for different purposes while changing the type of the process kit from one to another.

Although the use of such easily detachable or exchangeable process kits have many merits in the utility and maintenance of the apparatus, there may be produced some problem in the user's handling of the kit. Such a process kit is usually provided with a driving connection part provided thereon through which the kit is connected to the main body of the copying apparatus and through which the driving force is transmitted to the photosensitive drum from the main body. If the driving connection part is damaged by shock and impact, it is rendered unable to normally transmit the driving force to the photosensitive drum. Thereby the quality of images is reduced. In the worst case, the rotation center of the photosensitive drum is dislocated and rendered eccentric, so that it is no longer possible to obtain sharp and clear images. When the process kit is handled by the user, the possibility of damage is not small. In demounting the kit from the main machine or in carrying it after demounting, the man may strike the driving connection part against any rigid body such as desk, wall, pillar or floor. This is an important problem involved in the use of process kit.

SUMMARY OF THE INVENTION

Accordingly, it is the general object to solve the problem of damage to the process kit detached from the main apparatus.

A more specific object of the invention is to provide means for effectively protecting the driving connection part of the process kit against damage.

Another object of the invention is to prevent the driving connection part from being damaged by external shock and also to prevent the center axis of the rotating photosensitive drum from being deviated thereby preventing the reduction of image quality.

Other and further objects, features and advantages of the invention will appear more fully from the following description.

To attain the objects according to the invention there is provided a process kit attachable to and detachable from the main image-forming apparatus which includes a photosensitive drum, image formation processing means arranged around the drum, a frame for supporting the photosensitive drum and said processing means and a driving connection member as described above. On the same surface of the frame on which the connection member is provided, there are provided projections arranged around the connection member. The projections project outward beyond the level of the connection member so that the connection member is protected by the projections against external impact.

DETAILED DESCRIPTION OF PREFERRED EMBODIMENTS

Figure 1:
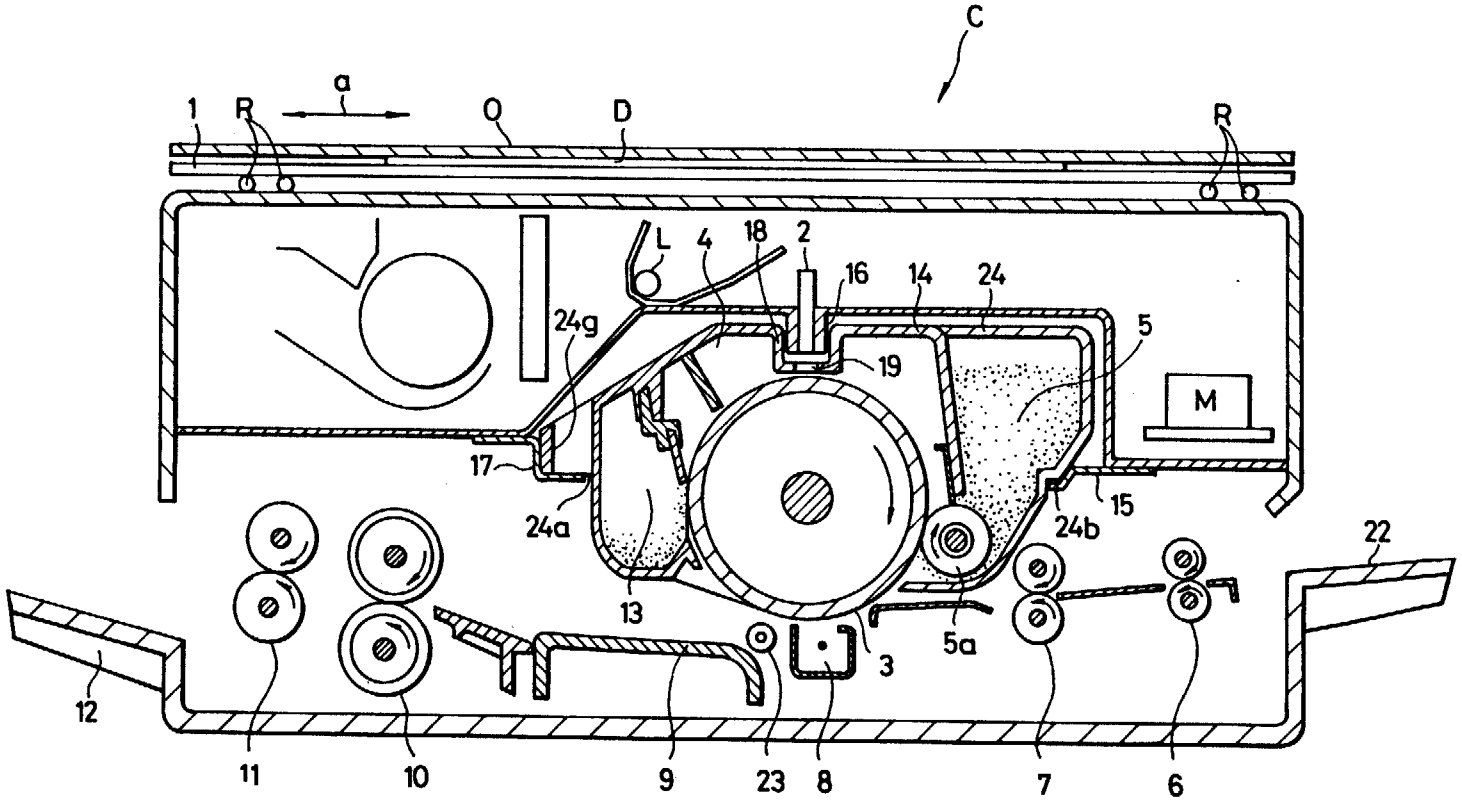
FIG. 1 is a sectional view of an electrophotographic copying machine in which a process kit according to the invention is used.
Figure 2:
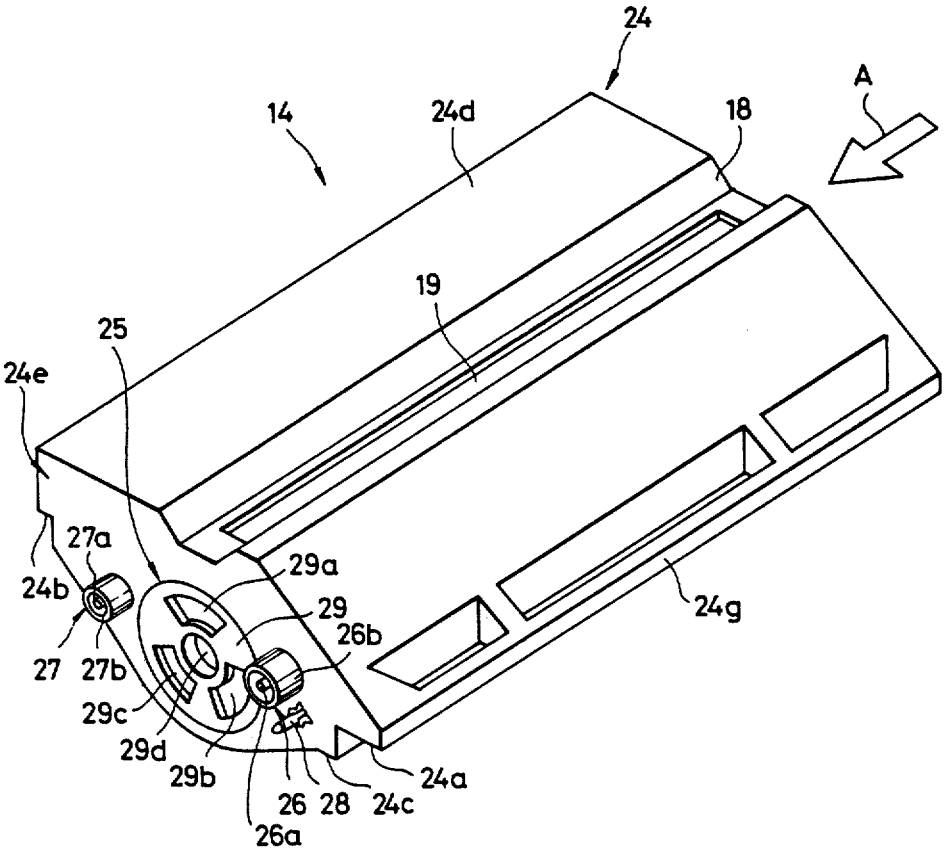
FIG. 2 is a perspective view of the process kit showing the structure on the inner side surface of the kit.
Figure 3:
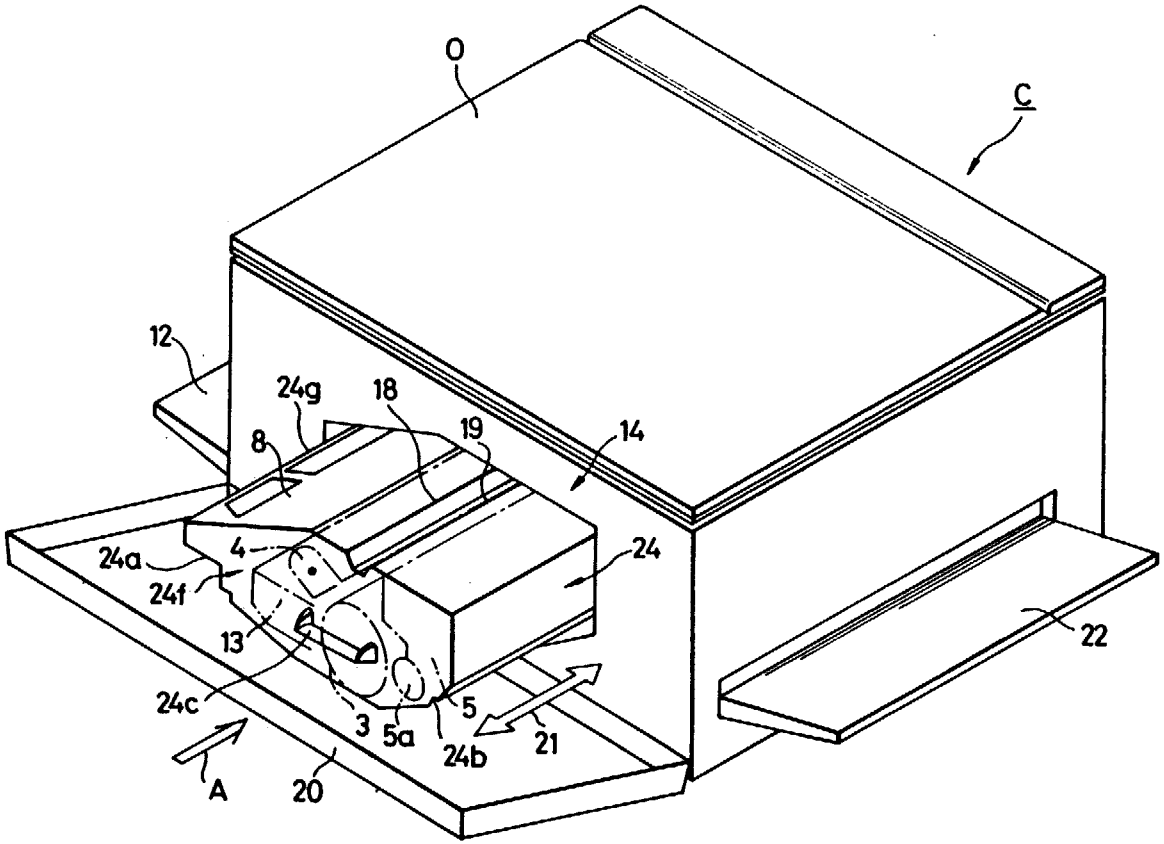
FIG. 3 illustrates the manner of mounting of the process into the main apparatus.
Figure 4:
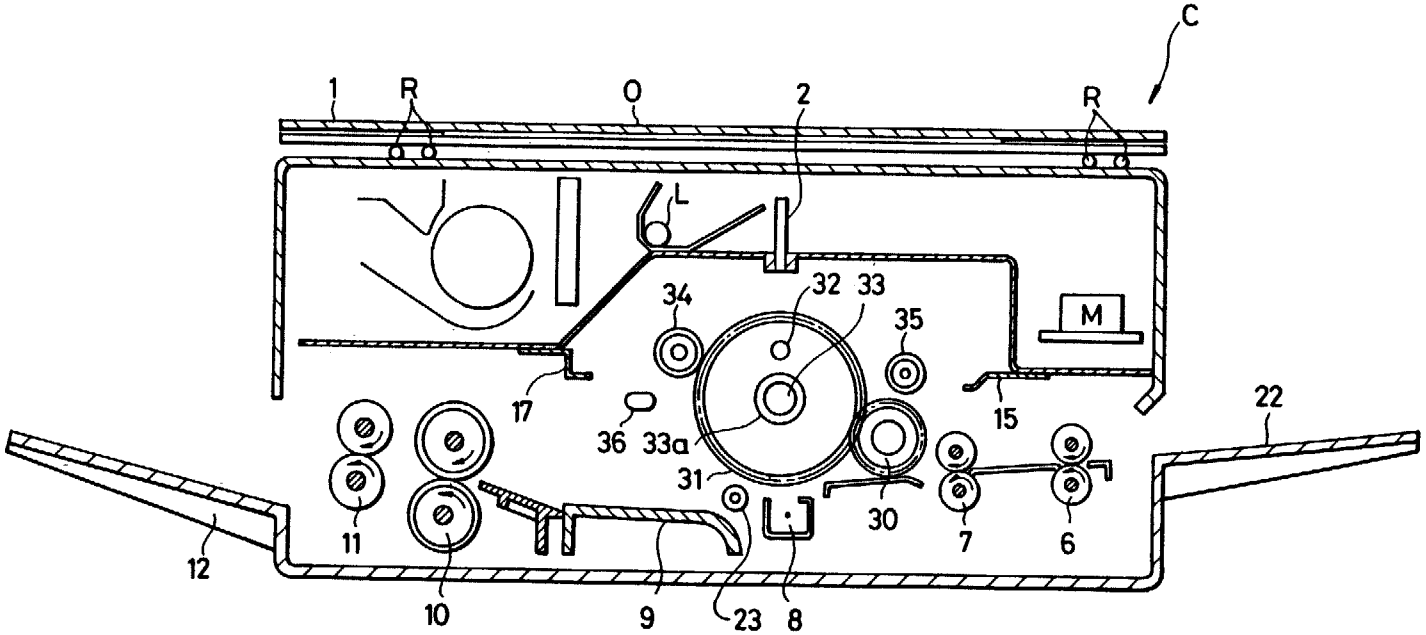
FIG. 4 is a sectional view of the copying machine showing the driving power transmission system on the side of the main body.

An embodiment of the present invention will be described with reference to FIGS. 1 through 4 wherein FIG. 1 shows a copying machine with a process kit according to the invention, FIG. 2 is a perspective view of the process kit, FIG. 3 illustrates the manner of mounting of the process kit in the copying machine and FIG. 4 shows the copying machine after the removal of the process kit from the main body of the copying machine.

The copying machine includes an original carriage 1 formed of a transparent member such as a glass plate which is normally covered with a cover member 0. An original D is placed on the original carriage 1 and the carriage is reciprocally moved in the direction of arrow a along rails R by means of a driving mechanism known per se. The original D on the moving original carriage 1 is illuminated by a lamp L and the reflected image of the original is projected on a photosensitive drum 3 through an array of small image-forming elements having short focal lengths designated by 2. The photosensitive drum 3 is uniformly precharged by a corona charger 4. As the result of the above image-wise exposure through the image-forming element array 2 there is formed an electrostatic latent image on the uniformly precharged surface of the drum 3. The latent image is then visualized by a developing device 5 which has a developing electrode roller 5*a* with the rotation of which toner is applied onto the drum surface. The developed image is transferred to a transfer sheet from the drum surface. The transfer sheet is manually fed from a transfer sheet supply tray 22 toward the nip between a pair of paper feed rollers 6. Through the paper feed rollers 6 and then a pair of registering rollers 7 the transfer paper is fed into the area of the drum 3 where the toner image is transferred to the transfer sheet from the drum under the action of a transfer charger 8. After transferring the transfer sheet is separated from the drum surface and guided to a fixing device 10 by a guide 9. The toner image is fixed on the transfer sheet by the fixing device. After completing the fixing, the transfer paper is discharged onto a discharged paper tray 12 from the machine by a paper discharge roller 11. On the other hand, after transferring, the photosensitive drum 3 enters the cleaning station where the remaining toner on the drum surface is removed off by a cleaning means 13.

In this embodiment, the photosensitive drum 3, charger 4, developing device 5 and cleaning means 13 are assembled together into a unit. The unit is supported on a frame 24 so as to form a detachable process kit 14 as seen best in FIG. 2. However, it is to be understood that the members which are to be assembled together into a process kit are never limited to those shown in the above only. Many embodiments of the process kit are possible in the light of the above teachings.

16 is a mounting plate for the image-forming element array 2. 18 is a recessed portion formed in the frame 24. 19 is an opening provided in the recessed portion 18 of the frame 24. The position of the opening 19 corresponds to the array 2.

In this embodiment, the process kit 14 shown in FIG. 2 is inserted into the main body of the copying machine in the direction of arrow A and in the manner as illustrated in FIG. 3. As shown in FIG. 2 the frame 24 of the process kit has a side plate 24*e* on the inner-most side of the kit as viewed in the direction of insertion. On the outer-most side opposite to the inner side plate 24*e*, the frame has a side plate 24*f* provided with a hand grip 24*c* for drawing out the process kit from the main body of the copying machine as shown in FIG. 3. On the inner side plate 24*e* there are provided a driving connection means 25 composed of a disk-like member 29, a voltage connection part including connectors 26 and 27, and a stopper pin 28.

After mounting the process kit in the main body C of the copying machine, the driving connection part 25 transmits a rotating force from the main body C to the photosensitive drum 3 in the manner as will be described later in detail. The connector 26 of the voltage connection part transmits a voltage from the main body C to the corona charger 4. The connector 27 transmits a voltage from the main body to the developing electrode roller 5*a*. The stopper pin 28 prevents any rotation of the process kit 14 after mounting. As seen best from FIG. 2, the driving connection part and the voltage connection part are on the same plane of the side plate 24*e* and arranged in the same orientation. The connector pins 26*a* and 27*a* of the connectors 26 and 27 are enclosed with connector walls 26*b* and 27*b* respectively. The connectors 26 and 27 are located in the vicinity of the driving connection part 25 and arranged opposed to each other with the driving connection part 25 therebetween. The connectors project outwardly beyond the level of the driving connection part 25. The position of the connector 27 on the frame 24 corresponds to the position of the developing device 5 whereas the position of the connector 26 corresponds to the corona charger 4. The driving connection part 25 composes a disk 29 rotatably mounted on the side plate 24*e* for rotation together with the photosensitive drum 3. The disk 29 has three slots 29*a*, 29*b* and 29*c* provided for the purpose as will be described hereinunder.

The manner of connection of the process kit 14 with the main body C at the above-mentioned driving connection part and the voltage connection part will be described hereinafter with reference to FIGS. 4 and 5.

In FIG. 4 showing the copying machine in the position after demounting the process kit, 30 is a gear in mesh with a drum gear 31 and M is a motor. The rotation of the motor M is transmitted to the gear 30 through a suitable transmission such as a gear train or chain (not shown) so that the drum gear 31 is rotated by the gear 30 driven by the motor. On the drum gear 31 there is provided a driver pin 32 engageable with the driving connection part 25. More particularly, the driver pin 32 is so positioned as to engage in any one of the above-mentioned slots 29*a*, 29*b*, 29*c* formed in the disk 29. Through the engagement of the pin 32 with the disk 29, the rotating force can be transmitted to the photosensitive drum 3 from the main body C.

33 is a drum gear shaft which serves to position the process kit 14 in the direction for insertion and also serves as an electrode for keeping the drum 3 at ground potential. 34 is a high voltage connector provided on the main body's side to apply a high voltage to the corona charger 4. 35 is also a high voltage connector provided to apply a developing bias voltage to the developing roller 5*a* of the developing device 5.

Figure 5A:
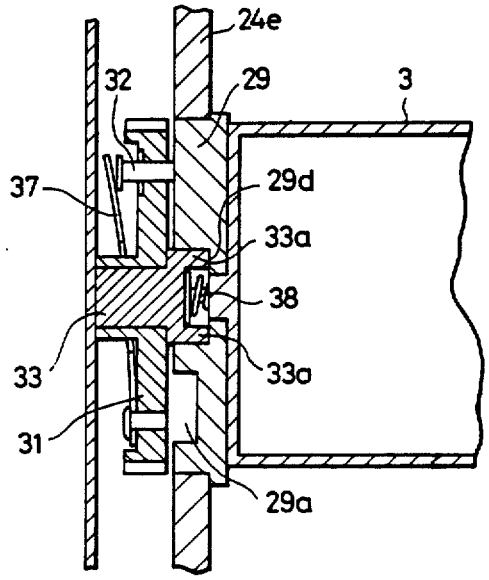
FIG. 5A is a partial sectional view showing the driving connection member of the process kit during the connection to the main apparatus and FIG. 5B is a view similar to FIG. 5A showing the driving connection member after the start of operation.
Figure 5B:
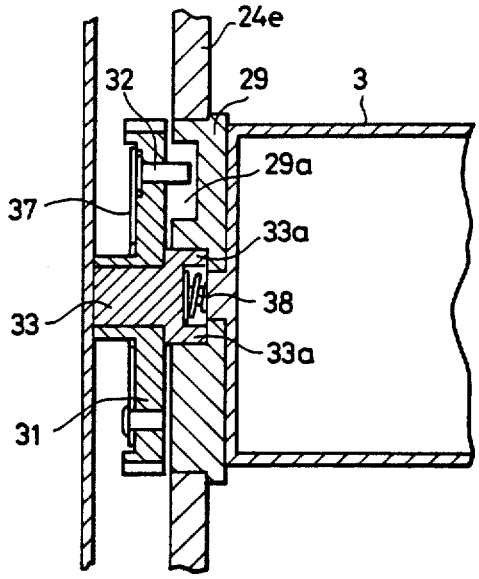

FIGS. 5A and 5B show the manner of engagement of the driver pin 32 on the drum gear 31 with the driving connection part 25.

In mounting the process kit 14 in the main body C of the copying machine, the user first places the slide portions 24*a* and 24*b* of the process kit 14 on the rails 15 and 17 (FIGS. 1 and 4) in the main body C and then inserts the kit 14 into the main body C along the rails until the disk 29 on the inner side plate of the kit abuts against the free end of the driver pin 32 on the main body C. The pin 32 is under the spring force of a leaf spring 32 which intends to press the enlarged base end portion of the pin against the back surface of the drum gear 31. When the free end of the pin 32 is pushed by the disk of the inserted process kit 14, the pin 32 is slightly moved backward against the force of the leaf spring 37 as shown in FIG. 5A. In this position, the free end 33*a* of the drum gear shaft 33 is received in the center bore 29*d* of the disk 29 and in contact with the bottom of the bore 29*d*. Thus, the positioning of the process kit 14 is completed. After completing the positioning of the inserted process kit 14 in the main body C, the kit is finally locked in the determined position by locking means (not shown) provided on the main body C at the kit inlet portion. When the kit 14 reaches the determined position in the main body, the connectors 27 and 26 on the kit are also connected with the high voltage connectors 35 and 34 on the main body respectively.

In the position shown in FIG. 5A, the user can switch on the power source or the copy start button (not shown) of the machine. With the switch-ON, the drum gear shaft 33 starts rotating and therefore the pin 32 is moved together with the drum gear. In the course of this movement, the pin encounters one of the three slots 29*a*, 29*b*, 29*c* formed on the disk 29 and the pin engages in the slot which the pin first encountered (in the shown case it is the slot 29*a*). The position of the pin 32 after engaging in the slot is shown in FIG. 5B. Thus, the connection between the main body C and the process kit 14 is completed.

In the position shown in FIG. 5B, a high voltage can be applied to the charger 4 and the developing roller 5*a* through the connectors 34 and 26 and through the connectors 35 and 26 respectively from a voltage source (not shown) on the main body C as desired and in a determined timing. Also, the rotating force of the motor M on the main body C can be transmitted to the disk 29 on the process kit 14 through the drum gear driving gear 30, drum gear 31 and kit driver pin 32 to rotate the photosensitive drum 3.

In mounting the process kit 14, the stopper pin 28 engages in an elongate slot 36 on the main body C to serve as a positioning pin. After mounting the kit, the stopper pin 28 prevents the kit from being rotated by the rotating force of the driver pin 32 on the drum gear during operation. In FIG. 5, 33 is a spring fixed on the gear shaft 33. After mounting the process kit, the spring 38 is in contact with the drum 3 and serves as an electrode for maintaining the drum 3 at ground potential.

Figure 6:
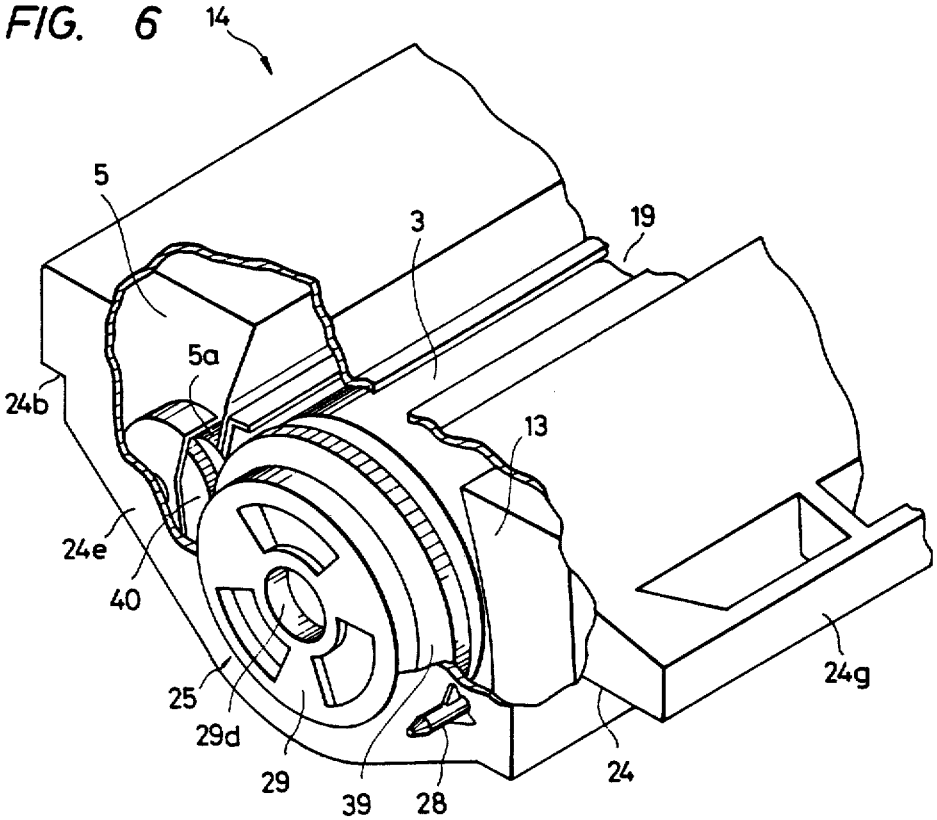
FIG. 6 is a partial perspective view, partly broken away, showing the transmission of driving force in the process kit.

FIG. 6 shows an embodiment of the rotating force transmission from the connection member 25 to the developing electrode roller 5*a*.

The disk 29 of the driving connection member 25 has a gear 39 integrally formed therewith. The gear 39 is in mesh with a gear 40 integrally formed with the developing roller 5*a*. When the disk 29 is driven into rotation by the rotating force transmitted from the main body in the manner as described above in connection with FIG. 5, the developing roller 5*a* is also rotated with the rotation of the disk.

As readily understood from the foregoing, the process kit shown in the above is very easy to mount in and demount from the main bod of the machine. When the process kit comes to the end of its useful time, any user can replace it by new one without any long interruption of the copying operation. Furthermore, it is possible to use one and the same main machine for different purposes by suitably selecting one kit among many different types of process kits according to the purpose for which the user intends to use the machine. For example, there may be prepared a kit for color development, a kit for reproduction of photograph with improved reproducibility of half-tone and a kit for copy making only of documents with improved edge effect. Users can keep these various kits in stock for exchange.

However, the use of such easily detachable and easily exchangeable process kits has a problem of increasing the posibility of damage on the kit in handling. The frequency of such case is increased where the handling of the process kit is done outside of the main machine and by those persons who are unfamiliar to it. In carrying the kit, the user may bump it against a rigid object such as a wall or may drop it down on the floor. Accordingly, the danger of damage is enhanced. This will bring about heavy loss in particular when the driving connection part is damaged by such accident. In the case of such process kit which has a driving connection part so formed as to receive the driving power from one and single driving source as in the case of the above embodiment, the breaking of the driving connection part renders the total process kit useless. In the case of such process kit in which the driving connection part is directly connected with a photosensitive drum, the impact applied to the connection part by accident will render the rotation axis of the drum eccentric, which has an adverse effect on the image formation.

According to the invention, the above problem is solved by arranging protective projecting parts around the driving connection part.

Figure 7:
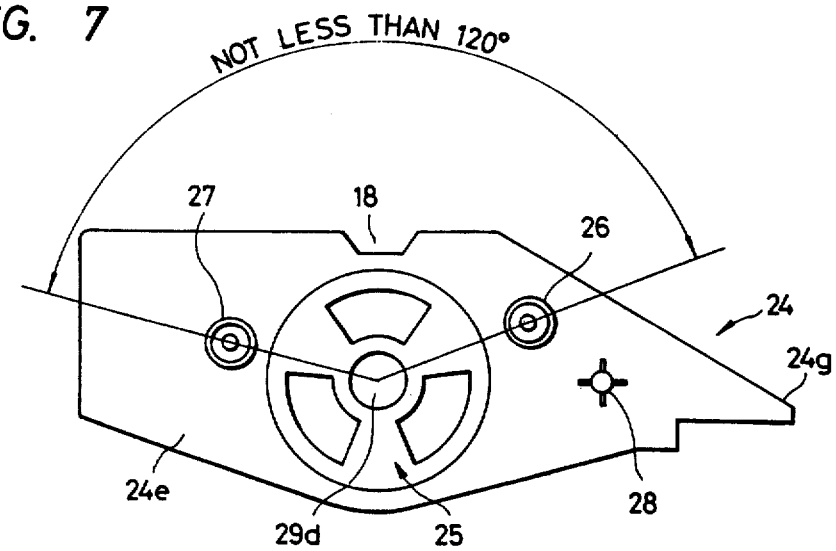
FIGS. 7 and 8 are front views showing two different examples of the arrangement of projections around the driving connection member.

In the embodiment previously described, the stopper pin 28 and the voltage connectors 26 and 27 are arranged around the connection member 25. These members 28, 26 and 27 project outwardly beyond the top level of the connector member 25. These projecting members form projections for protecting the connection member 25 against damage. To this end, as shown in FIG. 7, the pair of connectors 26 and 27 are arranged at the two opposite sides of the connection member 25 with the latter being sandwiched in between the two connectors 26 and 27. The angular distance between two projections, for example, between 26 and 27 relative to the center of rotation of the connection member 25 is more than 120 degrees.

With this arrangement, even when the process kit is accidentally struck against any rigid object such as a wall or the like, the connection member 25 can be protected against damage by means of the projections around the connection member. When the side wall of the kit frame 24 having the connection member 25 provided thereon is accidentally struck against any rigid object, the projecting connectors 26, 27 or pin 28 strike against the object but the connection member 25 never contacts with the rigid object. Thus, the connection member 25 is protected by the projections formed by the connectors 26, 27 and pin 28.

Figure 8:
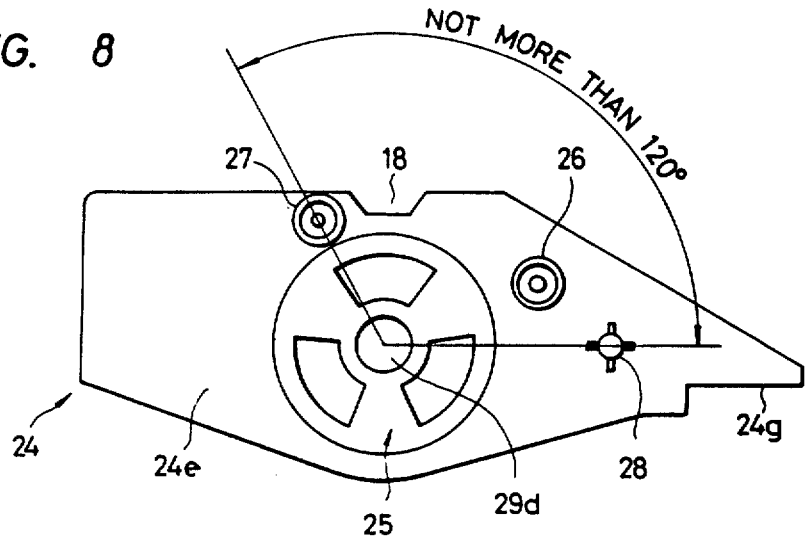

The result of our experiments has shown that the angular distance between two projections 26 and 27, 26 and 28 or 27 and 28 looking from the center of rotation of the connection member 25 should be larger than 120 degrees and that if the angular distance is less than 120 degrees as shown in FIG. 8 wherein the connection member 25 can not lie between two projections, then it is impossible to obtain any sufficient effect to protect the connection member against damage. In the case of arrangement as shown in FIG. 7 where the angular distance between the connector 27 and the pin 28 is larger than 120 degrees, there is obtained a sufficiently large protection effect. The angular relation herein referred to should be understood to denote the smaller one of two angles which two projections can form relative to the rotation center of the connection member 25.

In this manner, according to the present invention, very effective safety means for protecting the driving connection part against damage can be provided in a simple manner by arranging two or more projections around the connection part and at an angular distance larger than 120 degrees relative to the rotation center of the driving connection means which lies on one side surface of the process kit and is connected with the photosensitive drum. Of course, three or more such protective projections may be provided within the angular area larger than 120 degrees to obtain a further improved effect to protect the connection part against damage.

Figure 9:
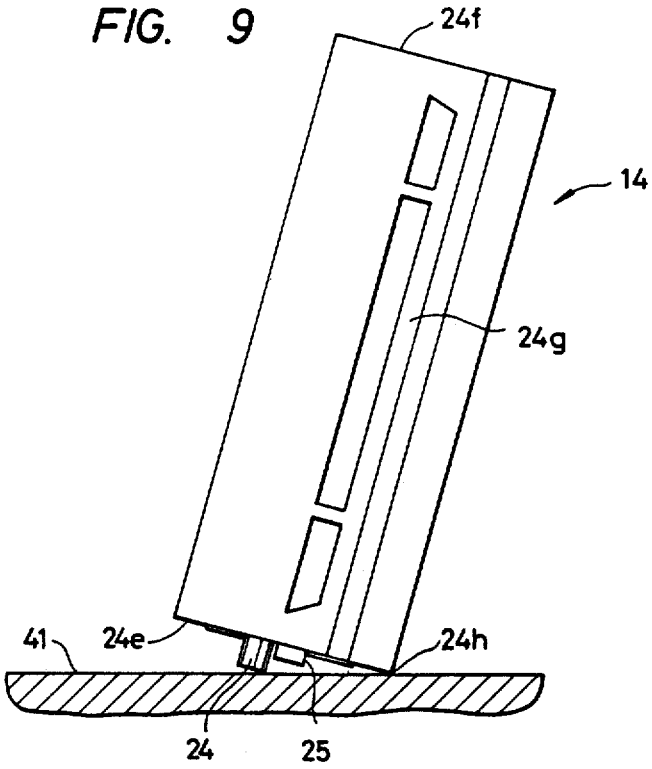
FIG. 9 is a side view of the process kit dropped down on the floor.
Figure 10:
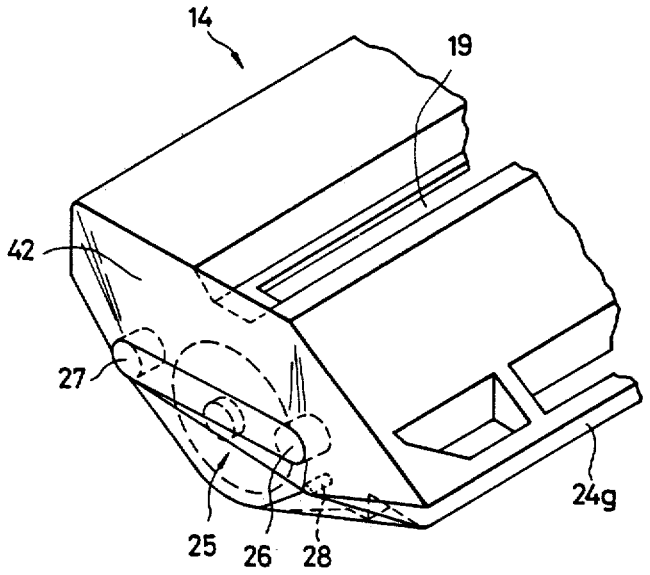
FIG. 10 is a partial perspective view of the process kit showing an embodiment of the arrangement of projections the driving connection member according to the invention.

FIG. 9 illustrates an example of the protection of the driving connection member 25 attained by the above embodiment. In the above shown embodiment, the protective projections are formed by the connectors 26, 27 and pin 28 projecting beyond the level of the connection member 25 and arranged around it on the same side wall **24*e* of the kit frame. After drawing out the kit 14 from the main body of a copying machine, the kit 14 may be placed or dropped down on a surface 41 of an object such as a desk with the side wall 24*e* down as illustrated in FIG. 9. In this case, the connection member 25 does not contact with the surface 4. It is contained safely within the space between the projecting connectors and the edge 24*h* of the frame 24. FIG. 9 also shows that even when the connection part 25 is so formed as to project a little from the wall surface 24*e*, the connection part can sufficiently be protected against direct contact with the surface 41 of an object such as desk or floor. Considering all possible cases where the process kit 14 is placed or dropped on the flat surface 41 with the side wall 24*e* of the frame down, a user can describe an envelope by binding the contact points of the projections and frame edges with the surface 41. FIG. 10 shows such an envelope 42. So long as the connection part 25 is contained within the envelope 42, there occurs no direct contact between the connection part 25 and the surface 41 no matter of the direction in which the process kit 14 is placed on the surface 41**.

Thus, the arrangement according to the invention prevents the driving connection member 25 from being damaged by its contact with any rigid object such as a desk or wall. Also, it prevents the photosensitive drum from being rendered eccentric by any shock as applied to it through the connection member.

As readily understood from the foregoing, the present invention has many effects and advantages.

An effective protection means for the connection part is provided by arranging power supply connectors, positioning pin and/or stopper pin in the form of projection around the connection part of a process kit. Even when the process kit is struck against a desk or a wall at the side wall of the frame on which the connection part is provided, the projections arranged around the connection part protect it against damage. Also, even if a user drops the process kit on any rigid object with said side wall surface down, no impact can be applied directly to the contact member.

As the connection part is protected against damage, all of the troubles caused by the damage on the connection part are completely eliminated according to the invention. Examples of troubles which may be caused by damage on the connection part and which can be eliminated by the arrangement of the invention are: inability to transmit the driving force from the main body to the process kit; irregular or disturbed driving of the photosensitive drum which in turn reduces the quality of formed images; dislocation of the rotation center of the photosensitive drum with which it is no longer possible to form sharp and clear images, and totally disordered operation. In summary, the present invention lessens the possibility that the process kit may be rendered useless in vain by man's careless handling of it before its useful life expires.

The presence of projections on the end surface of the process kit has an additional effect to prevent erroneous insertion of the process into the main body from the wrong direction. Furthermore, such projections serve also as a kind of precaution against the process kit being put on a desk or on a floor with its side surface down. Since the above shown process kit has protective projections on the inner side end wall of the kit frame and a hand grip on the outer side end wall as viewed in the direction of insertion, a user hesitates to put the kit on a desk or a floor with the side down. A user will usually place it on the desk or floor with another side surface down on which no projection exists. This is of importance in particular when the process kit contains a developing device and/or cleaning means. As the developing device and the cleaning device contain therein fluid toner, if the process kit is put on desk or floor with its side end surface down, that is, vertically, then the toner will flow toward one side of the toner container and accumulate together there in an unbalanced state. In the worst case, the toner flows over the container and is scattered in the kit. On the photosensitive drum there may be produced such area where developing of image or cleaning of toner is no longer possible. The protective projections on the inner side end and the projection of hand grip on the outer side end, therefore, serve also to prevent such trouble relating to toner. The presence of the handle 24 of the kit (FIG. 2) brings about an especially high effect for this purpose.

While the invention has been particularly shown and described with reference to preferred embodiments thereof, it will be understood that various changes and modifications may be made therein within the scope of the present invention.

For example, when the protective projections are formed making use of the power supply connectors, the number of the connectors may vary according to the image forming process for which the process kit is used or according to the content of processing means then used. It is not always necessary for the protective projections to have the same height. The thing essential for the protective projections is to have a sufficient height enough to attain the purpose of protecting the driving connection part against damage. Similarly, it is not always necessary for the side end surface of the process kit on which the projections are provided to be perfectly flat.

In the above embodiment, processing means contained in the process kit has been shown and described to include a charger, a developing device and cleaning means. However, it is to be understood that process means to be contained in a process kit according to the invention may comprise other components. Also, the kind of machine to which the process kit according to the invention is applicable is never limited to copying machines only. It is applicable to other types of image forming apparatus such as recorder and facsimile machines.

What we claim is:

1. A process unit mountable into and demountable from a main assembly, comprising:

an image bearing member rotatable about a rotational axis thereof;

process means actable on said image bearing member;

a casing for supporting said process means and for rotatably supporting said image bearing member;

a member for receiving a rotational drive force from the main assembly to rotate said image bearing member when said unit is mounted in the assembly;

an electrically conductive member provided at the rotational axis of said image bearing member, for sliding contact with an electrically conductive member of said main assembly to electrically connect said conductive shaft with the conductive member of the main assembly.

2. A unit according to claim 1, wherein said image bearing member is a photosensitive member, and wherein said process means includes a charger.

3. A unit according to claim 1, wherein said drive force receiving means is integral with said image bearing member and is provided with a recess with which a rotatable projection of the main assembly is engageable.

4. A unit according to claim 1, wherein said unit is provided, adjacent the rotational axis, with a coupling portion for coupling with a member of said main assembly to correctly position said process unit, when it is mounted in the main assembly.

5. A unit according to claim 1, wherein said process unit is insertable into the main assembly in a direction in which the rotational axis of said image bearing member extends, and said electrically conductive shaft of said process unit is adjacent a leading end thereof in the direction of the insertion.

6. A unit according to claim 1, wherein said coupling portion is formed in said drive force receiving member.

7. A unit according to claim 1, wherein said drive force receiving means is engageable with a member in the main assembly for transmitting the rotational drive force to said process means.

8. A unit according to claim 1, wherein said conductive member is effective electrically to ground said image bearing member.

* * * * *

UNITED STATES PATENT AND TRADEMARK OFFICE

CERTIFICATE OF CORRECTION

PATENT NO. : 4,714,337

DATED : December 22, 1987

INVENTOR(S) : FUMIO NISHINO, ET AL.

It is certified that error appears in the above-identified patent and that said Letters Patent is hereby corrected as shown below:

COLUMN 1

Line 25, "service man." should read --serviceman.--.
Line 28, "enables" should read --enable--.
Line 29, "service man." should read --serviceman.--.
Line 47, "have" should read --has--.

COLUMN 2

Line 38, "process into" should read --process kit into--.
Lines 56-57, "projections the" should read --projections around the--.

COLUM 3

Line 15, "image-wise" should read --imagewise--.
Line 57, "inner-most" should read --innermost--.
Line 59, "outer-most" should read --outermost--.

COLUMN 4

Line 63, "leaf spring 32" should read --leaf spring 37--.
Line 64, "intends" should read --tends--.

COLUMN 5

Line 40, "33 is a spring" should read --38 is a spring--.
Line 58, "bod" should read --body--.
Line 68, "half-tone" should read --halftone--.

UNITED STATES PATENT AND TRADEMARK OFFICE

CERTIFICATE OF CORRECTION

PATENT NO. : 4,714,337

DATED : December 22, 1987

INVENTOR(S) : FUMIO NISHINO, ET AL.

It is certified that error appears in the above-identified patent and that said Letters Patent is hereby corrected as shown below:

COLUMN 6

Line 5, "posibility" should read --possibility--.
Line 6, "case" should read --cases--.
Line 31, "connector" should read --connection--.

COLUMN 7

Line 27, "surface 4." should read "surface 41.--.
Line 34, "desk" should read --a desk--.

COLUMN 8

Line 9, "in vain by man's" should read --due to--.
Line 13, "process into" should read --process kit into--.
Line 27, "on desk" should read --on a desk--.
Line 52, "sufficient height" should read --height sufficient--.

COLUMN 9

Line 16, "shaft" should read --member--.

UNITED STATES PATENT AND TRADEMARK OFFICE

CERTIFICATE OF CORRECTION

PATENT NO. : 4,714,337

DATED : December 22, 1987

INVENTOR(S) : FUMIO NISHINO, ET AL.

It is certified that error appears in the above-identified patent and that said Letters Patent is hereby corrected as shown below:

COLUMN 10

Line 11, "shaft" should read --member--.
Line 14, "claim 1," should read --claim 4,--.

Signed and Sealed this

Fourteenth Day of June, 198

*Attest:*

DONALD J. QUIGG

*Attesting Officer*

*Commissioner of Patents and Trademarks*